US010584931B2

(12) United States Patent
Pintar

(10) Patent No.: US 10,584,931 B2
(45) Date of Patent: Mar. 10, 2020

(54) SYSTEMS AND METHODS TO PREVENT HOT-WIRING OF ELECTRONIC GUN RACKS

(71) Applicant: Blac-Rac Manufacturing, Inc., Boise, ID (US)

(72) Inventor: Kevin B. Pintar, Meridian, ID (US)

(73) Assignee: BLAC-RAC MANUFACTURING, INC., Boise, ID (US)

( * ) Notice: Subject to any disclaimer, the term of this patent is extended or adjusted under 35 U.S.C. 154(b) by 0 days.

(21) Appl. No.: 16/357,004

(22) Filed: Mar. 18, 2019

(65) Prior Publication Data

US 2019/0212088 A1 Jul. 11, 2019

Related U.S. Application Data

(63) Continuation of application No. 15/264,777, filed on Sep. 14, 2016, now Pat. No. 10,234,224.

(60) Provisional application No. 62/218,302, filed on Sep. 14, 2015.

(51) Int. Cl.

| | |
|---|---|
| ***F41A 23/18*** | (2006.01) |
| ***G08B 13/12*** | (2006.01) |
| ***G08B 13/14*** | (2006.01) |
| ***G07C 9/00*** | (2020.01) |
| ***G08B 13/06*** | (2006.01) |
| ***F41A 17/06*** | (2006.01) |

(52) U.S. Cl.

CPC ..... *F41A 17/066* (2013.01); *F41A 17/063* (2013.01); *F41A 23/18* (2013.01); *G07C 9/00706* (2013.01); *G07C 9/00896* (2013.01); *G08B 13/126* (2013.01); *G08B 13/1445* (2013.01); *G07C 2209/08* (2013.01); *G08B 13/06* (2013.01)

(58) Field of Classification Search

None

See application file for complete search history.

(56) References Cited

U.S. PATENT DOCUMENTS

| | | | | |
|---|---|---|---|---|
| 5,196,827 | A * | 3/1993 | Allen | F41A 23/18 340/568.1 |
| 7,658,028 | B2 | 2/2010 | Pintar et al. | |
| 8,266,835 | B2 | 9/2012 | Pintar et al. | |
| 9,349,266 | B2 | 5/2016 | Stoddard | |
| 2014/0263107 | A1 * | 9/2014 | Arabian | B60R 7/14 211/8 |
| 2014/0354399 | A1 * | 12/2014 | Allen | G08B 13/22 340/5.3 |
| 2015/0179006 | A1 | 6/2015 | Von Zurmuehlen et al. | |

OTHER PUBLICATIONS

US Patent and Trademark Office; Office Action; U.S. Appl. No. 15/264,777; dated Feb. 20, 2018.

US Patent and Trademark Office; Final Office Action for U.S. Appl. No. 15/264,777; dated Sep. 18, 2018.

* cited by examiner

*Primary Examiner* — Daniell L Negron

(74) *Attorney, Agent, or Firm* — Parsons Behle & Latimer

(57) ABSTRACT

A system includes a controller in communication with a transmission device. The system further includes a gun rack that includes a locking mechanism. The controller is configured to release the locking mechanism in response to receiving, from the transmission device via modulation on a power wire that powers the controller, a pattern that corresponds to a predetermined pattern.

20 Claims, 7 Drawing Sheets

SYSTEMS AND METHODS TO PREVENT HOT-WIRING OF ELECTRONIC GUN RACKS

CROSS-REFERENCE TO RELATED APPLICATIONS

This application is a continuation of and claims the benefit of U.S. patent application Ser. No. 15/264,777 filed on Sep. 9, 2016, issued as U.S. Pat. No. 10,234,224, and entitled "SYSTEMS AND METHODS TO PREVENT HOT-WIRING OF ELECTRONIC GUN RACKS," which claims the benefit of U.S. Provisional Patent Application Ser. No. 62/218,302 filed on Sep. 14, 2015 and entitled "Systems and Methods to Prevent Hot-Wiring of Electronic Gun Racks," the contents of each of which are hereby incorporated by reference in their entirety.

BACKGROUND

Gun racks provide measures to prevent the unauthorized access to a weapon by locking key portions of the weapon, thereby neutralizing it while in the gun rack. In order to lock the gun securely, locking mechanisms may be used to enclose the key portions of the gun. Examples of electronic gun racks are described with reference to U.S. Pat. No. 8,266,835 filed on Jan. 6, 2010 and entitled "Firearm Security Device," and with reference to U.S. Pat. No. 7,658,028 filed on Jan. 30, 2008 and entitled "Firearm Security Device," the contents of each of which are hereby incorporated by reference in their entirety.

A typical electronic gun rack may apply electrical current to a solenoid to release the lock on the gun rack. These electronic release mechanisms typically utilize a power source to provide power to the gun rack allowing release. Through this approach, the gun rack and access to a weapon, can potentially be obtained by unauthorized users by cutting the power wires and by providing a source of power outside of the designed release mechanisms or devices to unlock the gun rack. In this way, unauthorized users may obtain free access to a weapon mounted in a locked gun rack. Thus, an unauthorized user can cut the electrical wire and provide auxiliary power to power the solenoid and release the gun.

SUMMARY

To resolve the shortcomings of typical electronic gun racks, a pattern encoded in a signal, used to release the locking mechanism, may be encoded to prevent simple "hot-wiring." In an embodiment, a system may include a receiver configured to receive an encoded signal, decode it, and determine whether it is the proper signal to allow activation of the solenoid to release the locking mechanism. The system may further include a transmitter, which may be at another location, configured to transmit an encoded signal when receiving a request to unlock the gun rack.

In an embodiment, a method includes receiving, at a controller housed within a tamper resistant container of an electronic gun rack, a signal from a remote device. The signal includes a pattern. Further, the signal is received via modulation on a power wire that powers the controller. The method also includes determining whether the pattern corresponds to a predetermined pattern. The method includes, when the pattern corresponds to the predetermined pattern, releasing a locking mechanism. The power wire further powers the locking mechanism.

In some embodiments, the locking mechanism, when activated, selectively secures a gun to the gun rack. In some embodiments, the method further includes storing electrical energy from the signal and powering the controller using the stored electrical energy. In some embodiments, the pattern includes an analog frequency pattern, a digital coded pattern, or a combination thereof. In some embodiments, the signal is derived from voice recognition data, fingerprint data, retinal scan data, or a combination thereof. In some embodiments, the predetermined pattern is selected from multiple predetermined patterns, each of the multiple predetermined patterns associated with a user group or individual.

In an embodiment, the method includes receiving, at a controller housed within a tamper resistant container of an electronic gun rack, a signal from a remote device, the signal including a pattern, where the signal is received via wireless transmission. The method further includes determining whether the pattern corresponds to a predetermined pattern. The method also includes, when the pattern corresponds to the predetermined pattern, releasing a locking mechanism.

In some embodiments, the locking mechanism, when activated, enables a gun to be securely retained by the gun rack. In some embodiments, the signal is derived from voice recognition data, fingerprint data, retinal scan data, or a combination thereof. In some embodiments, the predetermined pattern is selected from multiple predetermined patterns, each of the multiple predetermined patterns associated with a user group or individual. In some embodiments, the wireless transmission implements protocols including active radio frequency identification (RFID) protocols, passive RFID protocols, Wi-Fi protocols, Bluetooth protocols, Zigbee protocols, WiMax protocols, Third Generation (3G) protocols, Global System for Mobile Communications (GSM) protocols, near field communication (NFC) protocols, or combinations thereof.

In an embodiment, a system includes a controller in communication with a transmission device. The system further includes a gun rack that includes a locking mechanism. The controller is configured to release the locking mechanism in response to receiving, from the transmission device via modulation on a power wire that powers the controller, a pattern that corresponds to a predetermined pattern.

In some embodiments, the controller is positioned within an enclosed portion of the gun rack. In some embodiments, the system further includes a power storage device configured to store electrical energy from a signal encoding the pattern and provide the stored electrical energy to power to the controller. In some embodiments, the system includes a demodulator to extract the pattern from modulations on a power wire.

In an embodiment, a method includes receiving electrical power from a power source. The method further includes modulating the electrical power to generate a signal, the signal including a pattern corresponding to a predetermined pattern stored at a controller of an electronic locking device associated with a locking mechanism of a gun rack. The method also includes transmitting the signal with the power to the electronic locking device.

In some embodiments, the the power source includes an emergency-vehicle siren/lights control box configured to provide the power for a duration of time upon activation. In some embodiments, the power source includes a vehicle power source. In some embodiments, the duration of time is user adjustable. In some embodiments, transmitting the power and the signal includes modulating the power based on the signal. In some embodiments, the method includes monitoring an electrical characteristic of a wire used to transmit the power, the signal, or both, and detecting whether the wire is severed based on changes to the electrical characteristic.

Figure 1:
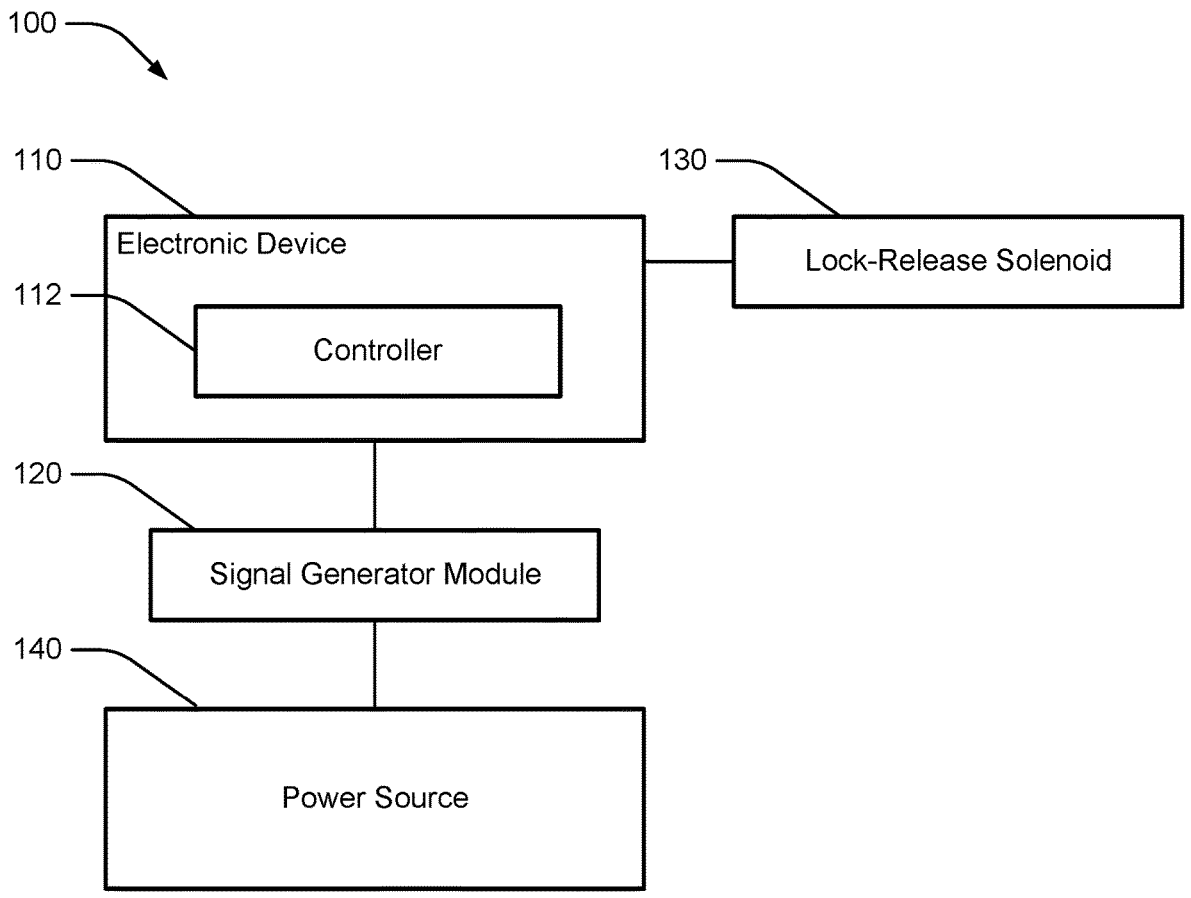
FIG. 1 is a block diagram of an embodiment of a system to prevent hot-wiring of electronic gun racks.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope of the invention as defined by the appended claims.

DETAILED DESCRIPTION

The disclosed systems and methods prevent application of an unauthorized power supply to activate the electronic release of a gun rack. This in turn prevents the unauthorized access to a weapon. In an embodiment, a method includes providing a signal code from a transmission source to a detection device inside a secure gun rack. The detection device may be able to "read" the code and prevent an outside power supply from activating the electronic release mechanism. In this way, the detection device prevents unauthorized access to a weapon.

The signal transmission source, the signal receiving device, or both may operate by electronic or wireless transmission using a power source of a vehicle or other mounting locations. Examples of other mounting locations include buildings or sentry posts. In some embodiments, the transmission source may be carried by individuals via remote device (e.g., radio frequency identifier (RFID) devices). Each electronic module can be programmed to determine whether to grant individual access, group access, or system wide access. The transmitted code/signal can be specific or unique by customization of the signal code transmission and the receiving device for any size of organization. Further, the transmitted code/signal can be modified as many times as required for a specific gun rack or subsets or an entire group or multiple entities without limitations.

Referring to FIG. 1, an embodiment of a system 100 for preventing the hot-wiring of an electronic gun rack is depicted. The system 100 may include an electronic device 110, a signal generator module 120, a lock-release solenoid 130, and a power source 140.

The electronic device 110 may include circuitry and/or other mechanisms to drive the lock-release solenoid 130. For example, the electronic device 110 may include a controller 112. The controller 112 may be communicatively coupled to the lock-release solenoid 130 either directly or through additional circuitry, such as buffers, transformers, step-circuits, amplifiers, switches, relays, other types of intermediate circuitry, or combinations thereof. The controller 112 may be an embedded processor, a central processing unit, a digital signal processor, a peripheral interface controller, a logic circuit unit, another type of processor or controller circuity, or combinations thereof.

The signal generator module 120 may include circuitry to generate and encode a signal. The signal generator module 120 may be coupled between the power source 140 and the electronic device 110. Further, the signal generated by the signal generator module 120 may be formed by modulating electrical power received from the power source 140 before passing the electrical power to the electronic device 110.

The power source 140 may include any source capable of providing power to operate the electronic device 110 and the solenoid 130. In some embodiments, the power source 140 may include an emergency vehicle siren/light control box.

The lock-release solenoid 130 may control a locking mechanism that selectively retains a gun within a gun rack. For example, activating or powering the lock-release solenoid 130 may cause a locking mechanism to open, thereby granting access to a weapon. Deactivating the lock-release solenoid 130 may cause the locking mechanism to close, thereby prohibiting access to the weapon.

During operation, the power source 140 may provide power to the electronic device 110 via the signal generator module 120. Actuation of the power source 140 to provide the power may be initiated in response to user input. For example, a user may turn a key, flip a switch or relay, input instructions via the controller 112, or combinations thereof. The power received from the power source may be sustained until shut off by a user or the power may be for a temporary duration. If it is temporary, it may be last long enough to actuate the lock-release solenoid 130 before ceasing. In some embodiments, the duration of power may be user adjustable.

The signal generator 120 may generate a pattern. The controller 112 may prevent the actuation of the lock-release solenoid 130 until the pattern is received by the controller 112. In some embodiments, the pattern may be encoded and passed to the controller 112 by modulating the power provided to the controller 112 by the power source 140. For example, the signal generator module 120 may be connected to the electronic device 110 with two wires. One wire may provide both the signal and a +12V drive voltage. The other wire may be a ground, negative current return path. The signal generator module 120 may modulate the +12V wire to provide the encoded pattern to the controller 112. After the pattern has been received by the controller 112, the signal generator 120 may continue passing the +12V potential for the remainder of a duration required to actuate the lock-release solenoid 130.

In some embodiments, the pattern may be passed to the controller 112 via independent signal wires. The electronic device 110 may trigger upon receiving a correct encoded pattern from the signal-generator module 120. By triggering, the electronic device 110 may pass power to the lock-release solenoid 130, thereby causing a locking mechanism to deactivate and release a gun.

In some embodiments, the pattern may begin with a sustained positive pulse. The positive pulse may be sufficient to charge a capacitor to provide power for the controller 112. In that way, the pattern can be read while the power supply input modulates. The remaining portion of the pattern may include a unique code shared between the electronic device 110 and the signal generator module 120. In some embodiments, the unique code may be derived from voice recognition, fingerprint, retinal scan, or any other biometric means. The pattern may be encoded as an analog frequency pattern, a digital coded pattern, or some combination thereof.

A benefit associated with the system 100 is that by including a signal generator module 120 the lock-release solenoid 130 cannot be actuated by cutting a power cord between the power source 140 and the electronic device 110 and applying an independent power source. In order to actuate the lock-release solenoid 130, the correct pattern must be received by the controller 112. Other benefits and advantages of the system 100 may be apparent to persons of skill in the relevant art having the benefit of this disclosure.

Figure 2:
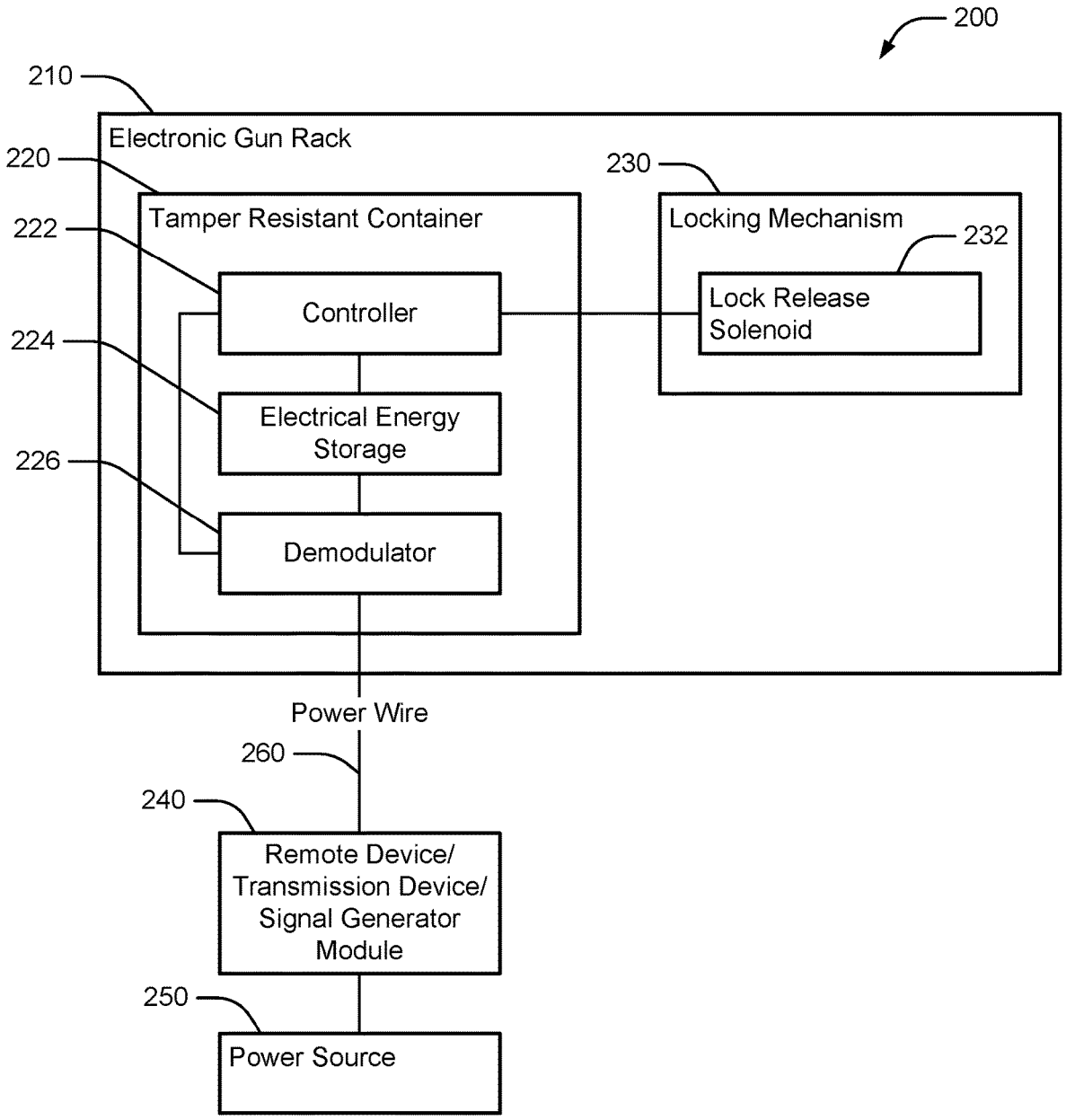
FIG. 2 is a block diagram of an embodiment of a system to prevent hot-wiring of electronic gun racks via a power wire.

Referring to FIG. 2, a system 200 for preventing hot wiring of an electronic gun rack 210 is depicted in further detail. The system 200 may include a tamper resistance container 220 and a locking mechanism 230 attached to or within the electronic gun rack 210. The system 200 may further include a remote device 240 (also referred to herein as a transmission device, or signal generator module). The remote device 240 and a power source 250 may be coupled to the tamper resistant container 220 via a power wire 260.

The tamper resistant container 220 may be formed from a material that is difficult to cut or open without using specialized equipment or tools. In this way, portions of the electronic gun rack 210 positioned within the tamper resistant container 220 may be kept free from unauthorized access. Within the tamper resistant container 220, the electronic gun rack 210 may include circuitry for controlling and limiting access to a gun locked by the electronic gun rack 210. The circuitry may include a controller 222, an electrical energy storage device 224, and a demodulator 226. Although FIG. 2 depicts the modules positioned with the tamper resistant container 220 as distinct from each other, in some embodiments, one or more of the contents of the tamper resistant container 220 may be combined in a single module.

The electrical energy storage device 224 may include a capacitor or another type of device for storing electrical energy. The electrical energy storage device 224 may provide power to the controller 222 in order to enable the controller 222 to receive and compare a pattern received from the remote device 240 to a predetermined pattern.

The locking mechanism 230 may lock a gun, or other type of weapon, in place while activated and may release the weapon when deactivated. A lock-release solenoid 232 may be used to actuate the locking mechanism 230.

The remote device 240 may be coupled to the demodulator 226 and to the electrical energy storage device 224 via a power wire 260. The demodulator 226 may be configured to detect fluctuations on the power wire 260 and provide a detected pattern to the controller 222.

During operation, the power source 250 may provide power to the electronic gun rack 210 via the remote device 240. Actuation of the power source 250 to provide the power may be initiated in response to user input. For example, a user may turn a key, flip a switch or relay, input instructions via the controller 222, or combinations thereof. The power received from the power source 250 may be sustained until shut off by a user or the power may be for a temporary duration. If it is temporary, it may be last long enough to actuate the lock-release solenoid 232 before ceasing. In some embodiments, the duration of power may be user adjustable.

The remote device 240 may generate a pattern. The controller 222 may prevent the actuation of the lock-release solenoid 232 until the pattern is received by the controller 222. In some embodiments, the pattern may be encoded and passed to the controller 222 by modulating the power provided to the controller 222 by the power source 250 via the power wire 260 as described herein.

The pattern may be retrieved from the power signal using the demodulator 226. The pattern may then be passed to the controller 222 where it may be compared to one or more predetermined patterns. If there is a match, the controller 222 may pass power from the power wire 260 to the lock-release solenoid 232 of the locking mechanism 230. This may cause the locking mechanism 230 to deactivate, thereby granting access to a gun attached to the electronic gun rack 210.

The pattern encoded on the power wire 260 may begin with an extended pulse that may be used to charge the electrical energy storage device 224. The controller 222 may be powered by the electrical energy storage device 224 while performing a comparison of the pattern received from the demodulator 226 to the one or more predetermined patterns. After the initial pulse has charged the energy storage device 224, the remainder to this signal may be decoded to retrieve the pattern.

A benefit associated with the system 200 is that by refraining from releasing the locking mechanism 230 until a pattern received at the controller matches a predetermined pattern, the locking mechanism 230 cannot be actuated by cutting a power cord between the power source 250 and the electronic gun rack 210 and applying an independent power source because the independent source will be unable to provide a correct pattern. Other benefits and advantages of the system 200 may be apparent to persons of skill in the relevant art having the benefit of this disclosure.

Figure 3:
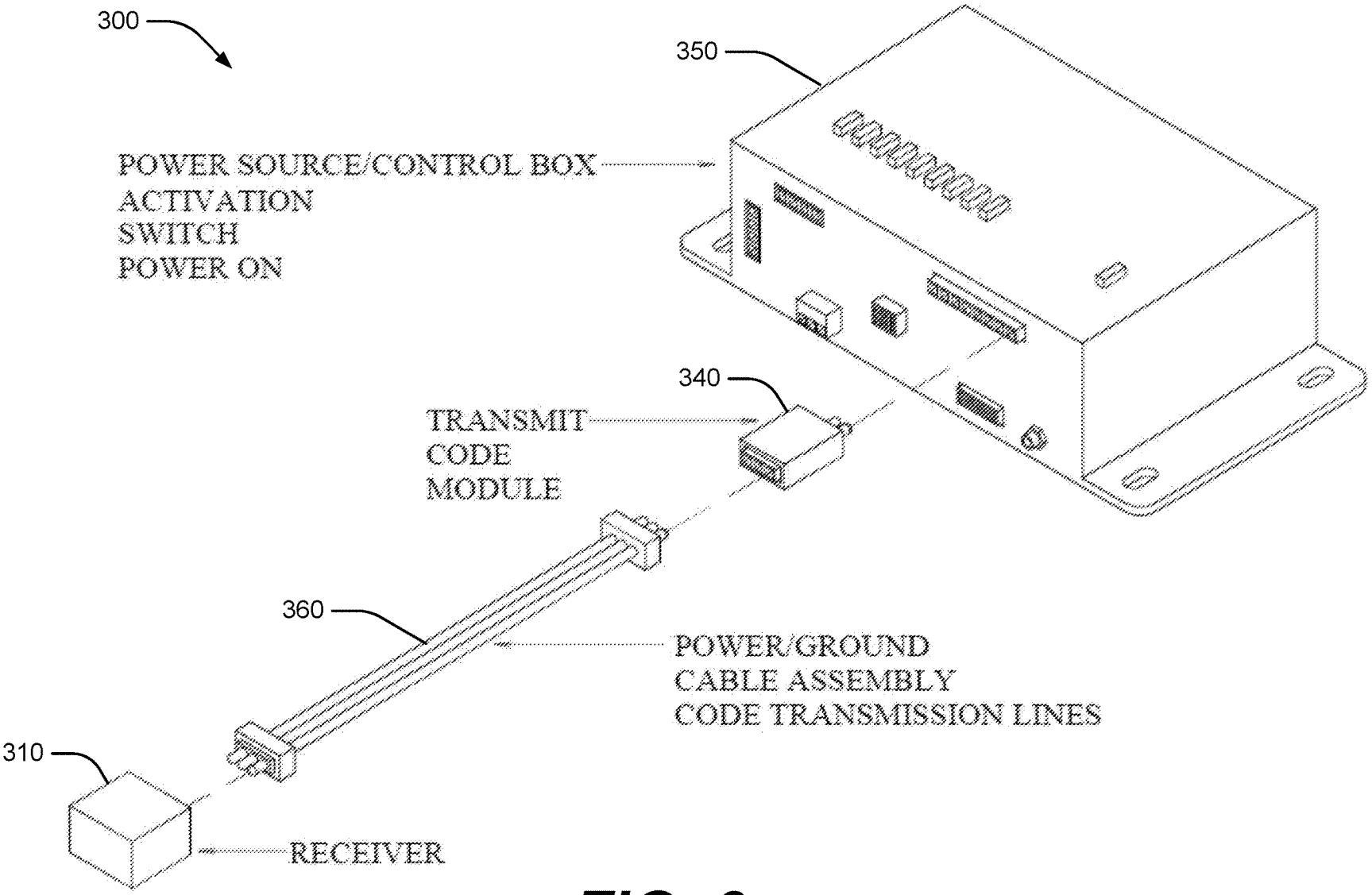
FIG. 3 is a perspective view of an embodiment of a system to prevent hot-wiring of electronic gun racks via a power cable assembly.

Referring to FIG. 3, a perspective view of an embodiment of a system 300 to prevent hot-wiring of electronic gun racks is depicted. The system 300 may be a part of an emergency-vehicle siren/lights control system. For example, the system 300 may include an emergency-vehicle siren/lights control box 350. The control box 350 may correspond to the power source 140 and the power source 250.

The system 300 may also include a transmit control module 340 which may correspond to the remote device 240 and/or the signal generator module 120. As depicted in FIG. 3, the transmit control module 340 may be located with the control box 350.

The system may also include a power/ground cable assembly 360. In some embodiments, the power/ground cable assembly 360 may include three wires (+12V wire, ground wire, encoded pattern transmission wire) as depicted by FIG. 3. In other embodiments, the encoded pattern is transmitted via the +12V wire as described herein. The pattern may then be received by a receiver 310 which may correspond to the electronic device 110 and/or the electronic gun rack 210.

In order for the receiver 310 to use power received via the cable assembly 360 the transmitted code signal must also be received 310. If an attempt to tamper with the receiver 310 is made by applying power to the cable assembly via an unauthorized power source, the receiver 310 will not respond unless the encoded pattern is also received from the transmit control module 340. Further, the transmit control module 340 may be configured to detect when any wire of the cable assembly 360 has been cut and may sound an alarm or provide an alarm signal.

A signal may be sent from the transmit control module 340 only when power has been appropriately applied by the control box 350. Thus, hotwiring of the receiver 310 is prevented by the inclusion of the transmit control module 340. The system 300 may be included within a mobile emergency unit, such as a vehicle used by police or military personnel, in order to prevent unauthorized access to a weapon.

Figure 4:
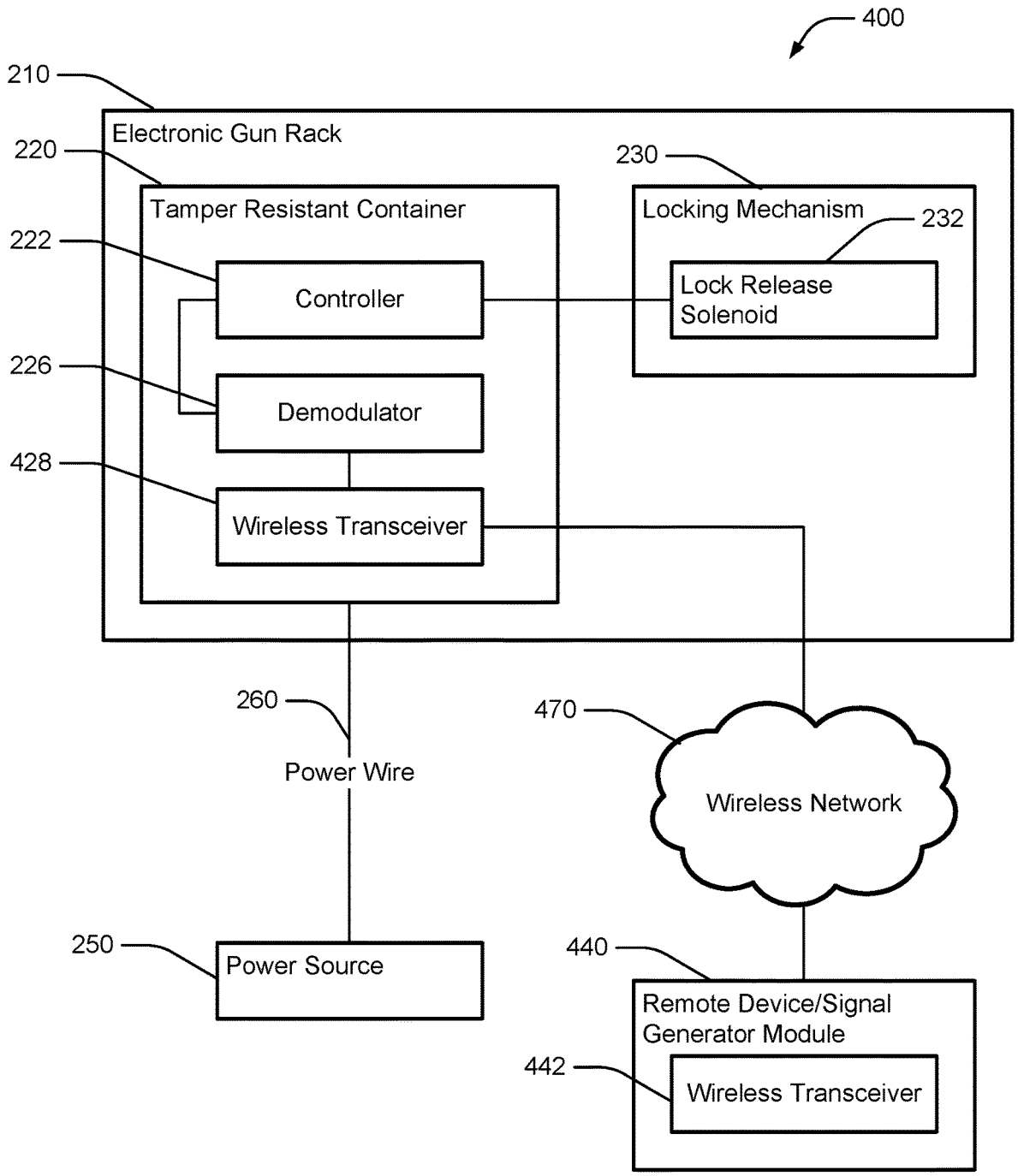
FIG. 4 is a block diagram of an embodiment of a system to prevent hot-wiring of electronic gun racks via a wireless network.

Referring to FIG. 4, an embodiment of a system 400 for preventing the hot-wiring of an electronic gun rack 210 is depicted. The system 400 may include a wireless transceiver 428 within the tamper resistant container 220. A remote device 440 may also include a wireless transceiver 442 and may be coupled to the wireless transceiver 428 via a wireless network 470. In the embodiment depicted in FIG. 4, the encoded pattern may be transmitted from the remote device 440 via the wireless network 470 instead of via the power wire 260.

The wireless transceivers 428, 442 may include any systems usable to pass encoded information wirelessly. For example, the wireless transceivers may implement active radio frequency identification (RFID) protocols, passive RFID protocols, Wi-Fi protocols, Bluetooth protocols, Zigbee protocols, WiMax protocols, Third Generation (3G) protocols, Global System for Mobile Communications (GSM) protocols, near field communication (NFC) protocols, other types of wireless transmission protocols, or combinations thereof. The wireless network 470 may include an RFID read/scan connection, a peer-to-peer connection, a local area network (LAN), a wide area network (WAN), another type of wireless network, or combinations thereof.

A benefit of communicating wirelessly to receive the encoded pattern, is that an authorized user may keep the remote device 440 on their person. The controller 222 may refrain from activating the lock release solenoid 232 unless the particular person is present with the remote device 440. Further, the controller 222 may compare the encoded pattern to multiple predetermined patterns associated with multiple users or user groups. This may enable the electronic gun rack 210 to be programmed to change user access.

Figure 5:
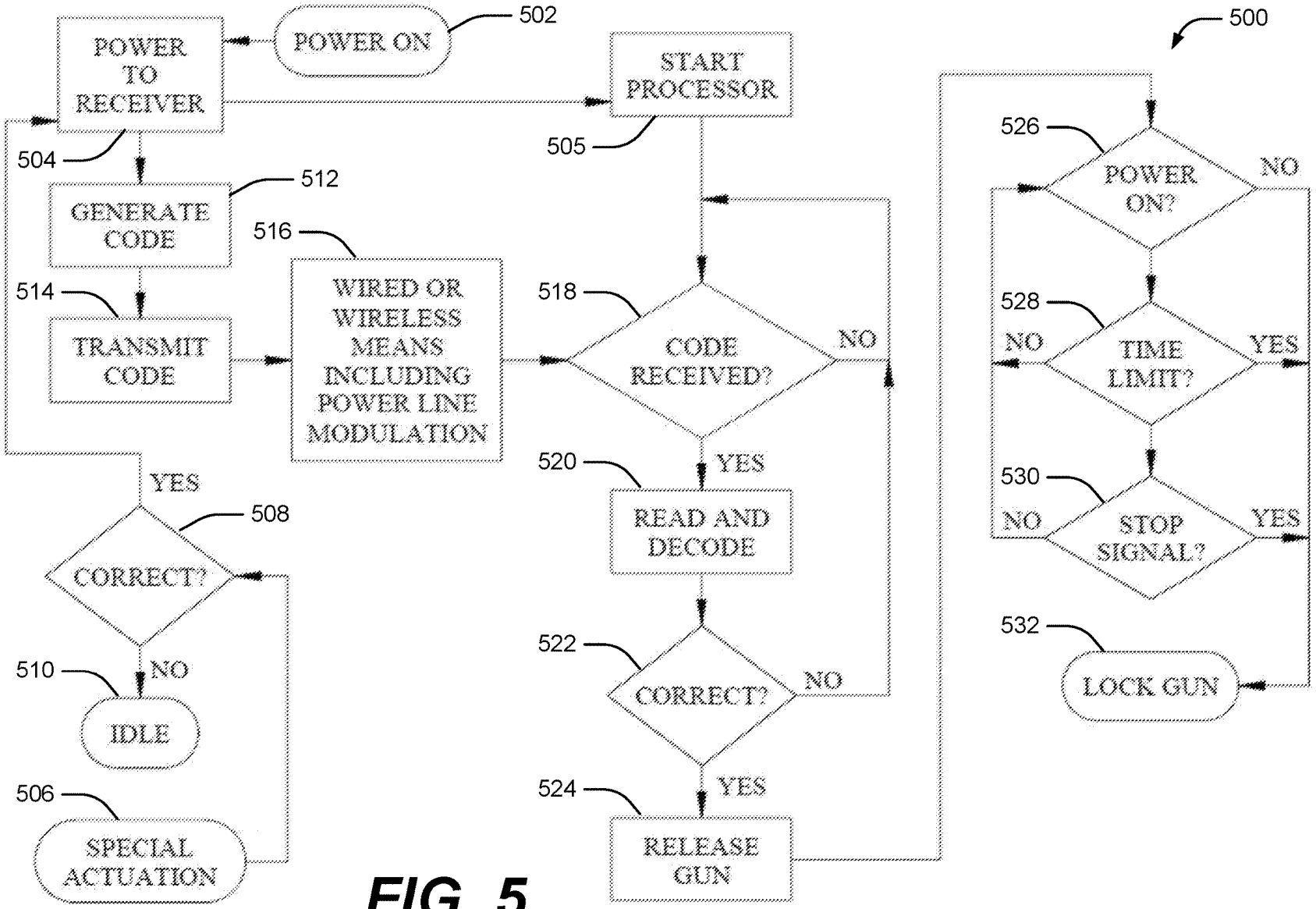
FIG. 5 is a flow diagram of an embodiment of a method to prevent hot-wiring of electronic gun racks.

Referring to FIG. 5, an embodiment of a method 500 for locking and unlocking an electronic gun rack while preventing hot wiring of the electronic gun rack is depicted. The method 500 may be initiated by user input including a key, a switch, a relay, controller actuation through a single wire, or applying power. When power is turned on, at 502, the power may be provided to a receiver, at 504.

The method 500 may further include starting a processor at the receiver in response to the power, at 505. Biometric or radio frequency activation that is unique to an authorized use or user may be required in order to continue the method 500. The method 500 may include receiving this unique actuation, at 506. At 508, the unique actuation may be compared to predetermined, or stored, data to determine whether the unique actuation is correct. If the actuation is incorrect, the process may idle, at 510, awaiting another instance of special actuation. Otherwise, the process may continue with receiving power at the receiving, at 504.

Based on the biometric and/or radio frequency activation a code may be generated, at 512. The code may be transmitted to an electronic gun rack, at 514. The code may be transmitted by wired or wireless means including power line modulation, as depicted at 516.

The processor at the gun rack may determine whether the code was received, at 518. If the code is not received, the processor may loop, continually polling to determine whether the code is received, at 518. Alternatively, persons of skill in the art would understand that the process could be interrupt-driven rather than relying on continuous polling.

Once the code is received, the method 500 may include reading and decoding the code at 520. Then the processor may determine whether the code is correct, at 522. If the code is not correct, the method 500 may include determining if another code is received, by returning to 518.

If the code is correct, the method 500 may include initiation an instruction to release a gun, at 524. In response to the instruction to release the gun, the method 500 may begin determining whether to relock the electronic gun rack. For example, the method 500 may include determining whether power is still on at the electronic gun rack, at 526. If the power is off, the electronic gun rack will be locked, at 532. If the power is on, the method 500 may include determining whether a time limit has been met, at 528. If the time limit has been met, then the electronic gun rack may be locked, at 532.

The method 500 may also include determining whether a stop signal has been received, at 530. If the stop signal has been received, then the electronic gun rack may be locked, at 532. The method 500 may continue until one of the criteria for locking the electronic gun rack has been met.

Figure 6:
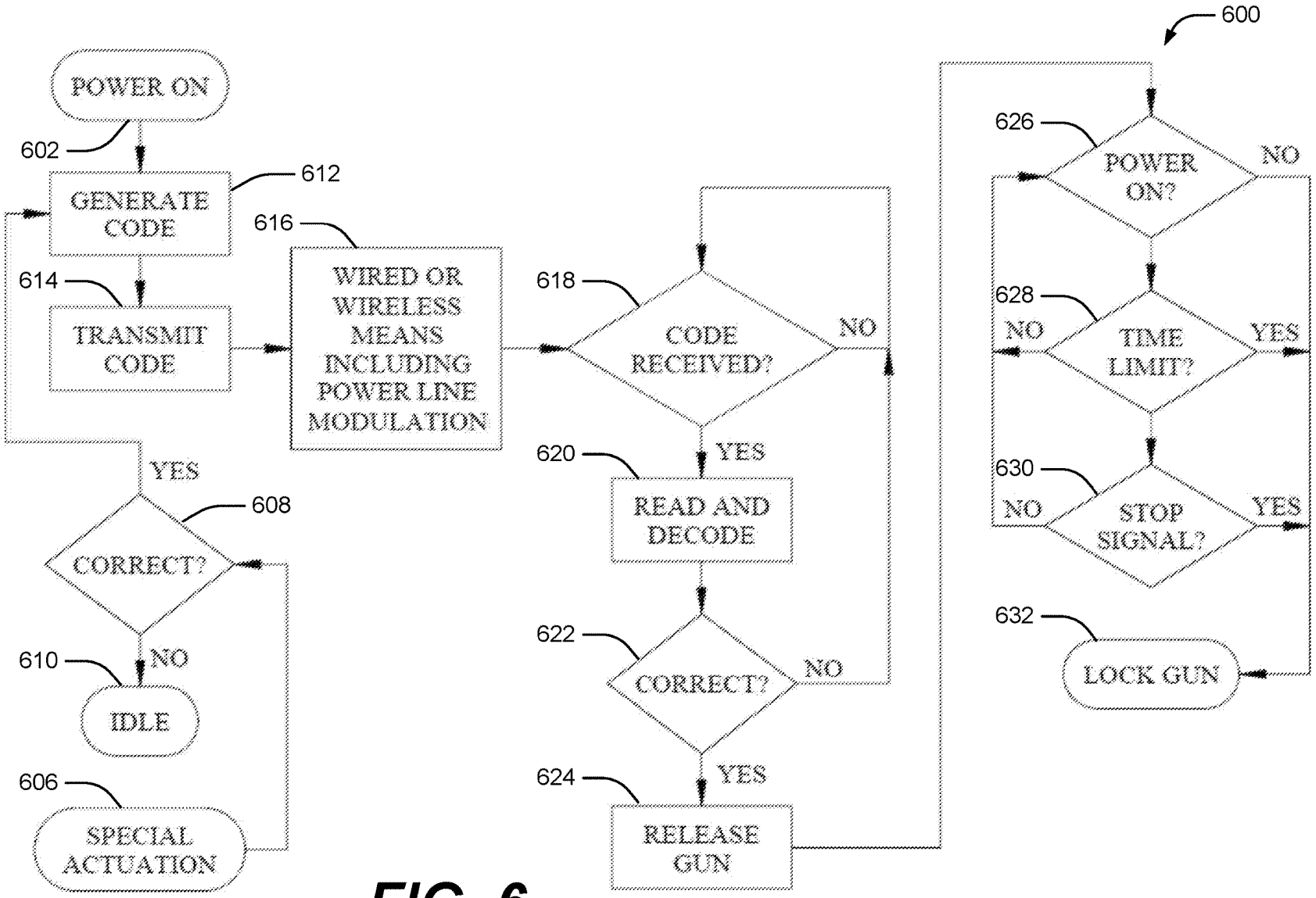
FIG. 6 is a flow diagram of an embodiment of a method to prevent hot-wiring of electronic gun racks.

Referring to FIG. 6, an embodiment of a method 600 for locking and unlocking an electronic gun rack while preventing hot wiring of the electronic gun rack is depicted. In the method 600, an independent power line is not provided to the processor at the gun rack. Rather, both power for actuating the electronic gun rack and the code may be provided via the same wire. Alternatively, the electronic gun rack may have an alternative power source.

The method 600 may include receiving power in response to a key, a switch, a relay, controller actuation through a signal wire, etc., at 602. Unlike the method 500, the method 600 may omit passing power directly to a receiver.

Similar to the method 500, the method 600 may include receiving special actuation at 606, determining whether the special actuation is correct, at 608, and if not, idling at 610. When the correct special actuation is applied, the method 600 may include generating a code, at 612. The code may be transmitted to the receiver, at 614. Wired or wireless means may be used to transmit the code including power line modulation, at 616.

Upon receiving the code, a processor at the receiving device may use power harvested from the signal used to transmit the code to power itself and determine whether the code was received, at 618. From there, the method 600 is the same as the method 500, including reading and decoding the code, at 620, determining whether the code is correct, at 622, releasing an electronic gun rack, at 624, determining whether power is still on, at 626, determining whether a time limit has expired, at 628, determining whether a stop signal has been received, at 630, and once one of the criteria has been met, locking the electronic gun rack, at 632.

Figure 7:
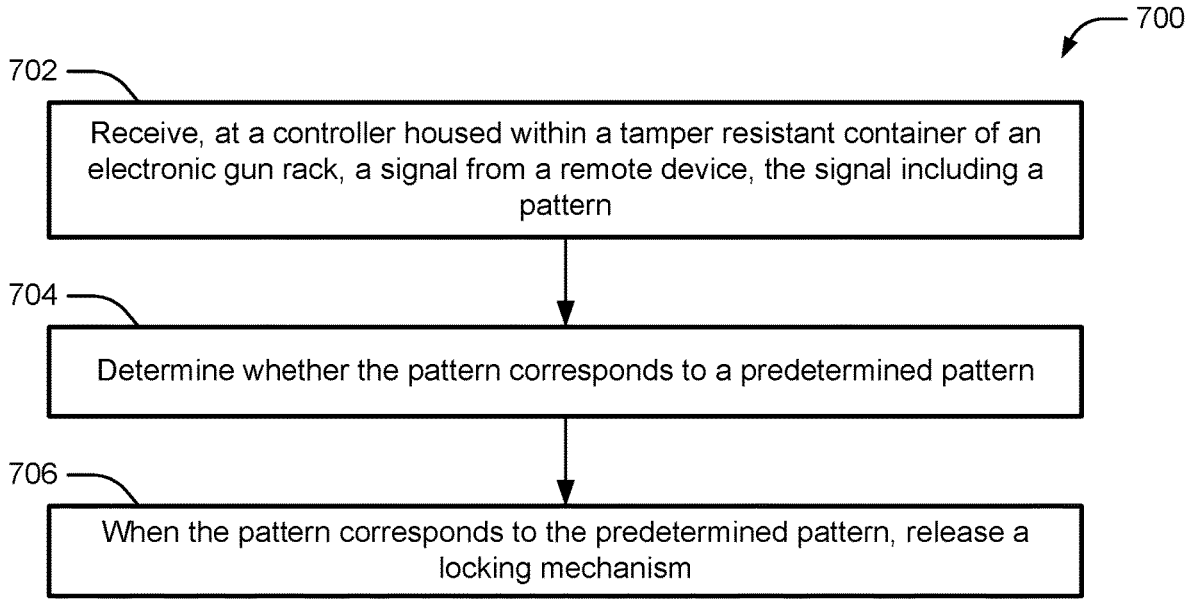
FIG. 7 is a flow diagram of an embodiment of a method to prevent hot-wiring at an electronic gun rack.

Referring to FIG. 7, an embodiment of a method 700 for preventing hot wiring of an electronic gun rack is depicted. The method 700 may include receiving, at a controller housed within a tamper resistant container of an electronic gun rack, a signal from a remote device, the signal including a pattern, at 702. For example, the signal may be received from the remote device 240 via the power wire 260. As another example, the signal may be received from the remote device 440 via the wireless network 470.

The method 700 may further include determining whether the pattern corresponds to a predetermined pattern, at 704. For example, the controller 222 may determine whether the pattern corresponds to one or more patterns stored at the controller 222. The predetermined patterns may correspond to a user or group of users and may be reprogrammable.

The method 700 may also include, when the pattern corresponds to the predetermined pattern, releasing a locking mechanism, at 706. For example, the locking mechanism 230 may be released by actuating the lock-release solenoid 232.

Figure 8:
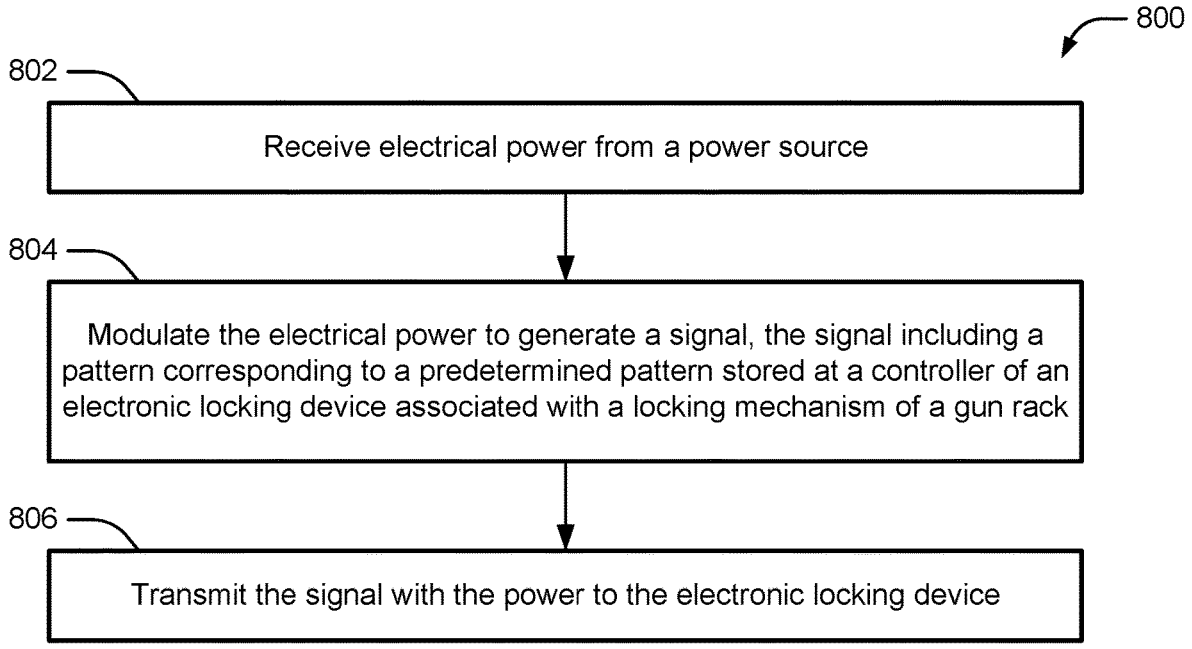
FIG. 8 is a flow diagram of an embodiment of a method to prevent hot-wiring at a signal generator device.

Referring to FIG. 8, an embodiment of a method 800 for preventing hot wiring of an electronic gun rack is depicted. The method 800 may include receiving electrical power from a power source, at 802. For example, the remote device 240 may receive power from the power source 250.

The method 800 may further include modulating the electrical power to generate a signal, the signal including a pattern corresponding to a predetermined pattern stored at a controller of an electronic locking device associated with a locking mechanism of a gun rack, at 804. For example, the remote device 240 may modulate power received from the power source 250. The pattern may correspond to a predetermined pattern stored at the controller 222.

The method 800 may also include, transmitting the signal with the power to the electronic locking device, at 806. For example, the remote device 240 may transmit the signal with the power to the electronic gun rack 210.

Although various embodiments have been shown and described, the present disclosure is not so limited and will be understood to include all such modifications and variations are would be apparent to one skilled in the art.

What is claimed is:

1. A system comprising:

an electronic gun rack comprising a controller and a solenoid;

a signal generator that is distinct from the gun rack and is configured to couple to a vehicle power source and configured to generate a pattern;

a first wire coupled between the electronic gun rack and the signal generator, the signal generator configured, upon activation, to send both a direct current voltage and the pattern to the electronic gun rack via the first wire coupled between the electronic gun rack and the signal generator that is distinct from the gun rack; and a second wire coupled between the electronic gun rack and the signal generator, the second wire providing a ground reference to the electronic gun rack.

2. The system of claim 1, wherein the controller is positioned within a tamper-resistant container.

3. The system of claim 1, wherein the direct current voltage is a 12-volt drive voltage.

4. The system of claim 1, further comprising:

a power storage device configured to store electrical energy from the direct current voltage and provide the stored electrical energy to power to the controller.

5. The system of claim 1, wherein the signal generator is configured to maintain the direct current voltage for a predetermined duration of time.

6. The system of claim 1, wherein the signal generator sends the pattern to the electronic gun rack by modulating the direct current voltage.

7. The system of claim 1, wherein the controller includes a demodulator to demodulate the direct current voltage to retrieve the pattern.

8. The system of claim 1, wherein the solenoid is configured to unlock a locking mechanism in response to the direct current voltage and in response to the pattern corresponding to a predetermined pattern.

9. The system of claim 1, wherein the pattern includes an analog frequency pattern, a digital coded pattern, or a combination thereof.

10. The system of claim 1, wherein the controller is further configured to monitor an electrical characteristic of the first wire and to detect whether the wire is severed based on changes to the electrical characteristic.

11. A vehicle-based weapon retention system comprising:

an electronic gun rack configured to be mounted within a vehicle and comprising a controller and a solenoid;

a signal generator configured to be mounted in the vehicle and configured to generate a pattern; and a single power wire coupled between the electronic gun rack and the signal generator, the signal generator configured, upon activation, to modulate a power signal on the single power wire to encode a pattern therein and to send both the power signal and the pattern to the electronic gun rack via the single power wire.

12. The system of claim 11, further comprising:

a ground wire coupled between the electronic gun rack and the signal generator.

13. The system of claim 11, further comprising:

a tamper-resistant container enclosing the controller and the solenoid.

14. The system of claim 11, wherein the power signal is a 12-volt drive voltage.

15. The system of claim 11, further comprising:

a capacitor configured to store electrical energy from the power signal and to provide the stored electrical energy to power to the controller.

16. The system of claim 11, wherein the signal generator is configured to maintain the power signal for a predetermined duration of time.

17. The system of claim 11, wherein the controller includes a demodulator to demodulate the power signal to retrieve the pattern.

18. The system of claim 11, wherein the solenoid is configured to unlock a locking mechanism in response to the power signal and in response to the pattern corresponding to a predetermined pattern.

19. The system of claim 11, wherein the pattern includes an analog frequency pattern, a digital coded pattern, or a combination thereof.

20. The system of claim 11, wherein the controller is further configured to monitor an electrical characteristic of the power wire and to detect whether the wire is severed based on changes to the electrical characteristic.

* * * * *